US005127845A

United States Patent [19]

Ayer et al.

[11] Patent Number: 5,127,845

[45] Date of Patent: Jul. 7, 1992

[54] INSULATION DISPLACEMENT CONNECTOR AND BLOCK THEREFOR

[75] Inventors: George E. Ayer, Naperville; David J. Coulombe, Skokie; Milton A. Klayum, Itasca, all of Ill.

[73] Assignee: Reliance Comm/Tec Corporation, Chicago, Ill.

[21] Appl. No.: 518,541

[22] Filed: Apr. 27, 1990

[51] Int. Cl.[5] ..... H01R 4/24

[52] U.S. Cl. ..... 439/395; 439/571

[58] Field of Search ..... 439/395, 571, 712, 715, 439/402, 404, 572

[56] References Cited

U.S. PATENT DOCUMENTS

| | | | |
|---|---|---|---|
| 3,112,147 | 11/1963 | Pferd et al. | 439/402 |
| 3,243,498 | 2/1966 | Logan | 439/83 |
| 3,518,618 | 6/1970 | Swanson | 439/571 |
| 3,521,221 | 7/1970 | Lenaerts et al. | 439/402 |
| 3,636,500 | 1/1972 | Sedlacek | 439/395 |
| 3,777,223 | 12/1973 | Chandler et al. | 439/395 |
| 3,936,119 | 2/1976 | Ayer | 439/404 |
| 3,957,335 | 5/1976 | Troy | 439/571 |
| 4,381,800 | 5/1983 | Pohl | 439/402 |
| 4,611,880 | 9/1986 | Petersen et al. | 439/752 |
| 4,895,531 | 1/1990 | Vignoli | 439/404 |

*Primary Examiner*—Larry I. Schwartz
*Assistant Examiner*—Hien D. Vu
*Attorney, Agent, or Firm*—Trexler, Bushnell, Giangiorgi & Blackstone, Ltd.

[57] ABSTRACT

A terminal assembly includes a block and a plurality of clip-type terminals mounted to the block. The block is a dielectric body having a central section and fanning strip sections at opposed margins. The terminals are loosely received through the holes and have wire receiving portions on one side of the central section and lying intermediate the fanning-strip sections and base portions on the opposite side of the central section. A retaining plate engages with the body for enclosing the base portions of the terminals within the dielectric body. The retaining plate further has a plurality of elongate, parallel and spaced-apart raised rib portions arranged for engaging the base portions of the terminals, such that wire receiving portions thereof are held in position projecting through the holes. The terminals comprise clip terminals having a flat body that includes two opposed resilent arms cantilevered from the base of the terminal. The resilient arms are separated by a notch at an upper end for receiving a wire conductor, by a conductor-receiving slot that extends downwardly from a lower end of the notch, and by an enlarged aperture extending downwardly from a lower end of the slot to the base. Oppositely outwardly facing edges of the resilient arms extend downwardly at a divergent angle to the base and inwardly facing edges of the resilient arms defining the aperture diverge at a substantially identical angle, such that the portions of the resilient arm flanking the aperture are of constant width.

19 Claims, 2 Drawing Sheets

INSULATION DISPLACEMENT CONNECTOR AND BLOCK THEREFOR

BACKGROUND OF THE INVENTION

This invention relates to terminal block assemblies of the type used for terminating telephone lines on main distribution frames or like supporting surfaces.

The invention is also concerned with a novel and improved insulation displacement clip type of terminal for use with such a terminal block assembly.

The type of terminal block assembly with which the present invention is concerned has a dielectric body which mounts a plurality of terminal clips that are kept in place relative to the body by a retaining plate. Moreover, the retaining plate may be used to mount the block directly to a board, frame or other supporting surface. In applications where it is desired that the cable bundle be run under the terminal block, an additional standoff bracket may be mounted on the supporting surface, and be provided with means for removably supporting the terminal block.

One particularly advantageous type of terminal block assembly is shown in Troy U.S. Pat. No. 3,957,335 issued May 18, 1976. In the terminal block assembly of Troy, a dielectric body portion is provided with a plurality of side-by-side rows of holes through which the electrically conductive terminals project These terminals have wire receiving portions on one side thereof, and base portions on their opposite sides The retaining plate is arranged to slidably interfit over the body portion such that the terminal base portions are confined between the retaining plate and the surface of the body on which the side-by-side holes are formed, and through which the wire-receiving portions of the terminals project.

Preferably, these terminals comprise clip-type terminals, generally of the type shown, for example, in Sedlacek U.S. Pat. No. 3,636,500, issued Jan. 18, 1972. However, unlike the terminals shown in the Sedlacek patent, these terminals do not have further wire-wrap posts or other projections projecting from their base portions Moreover, these terminals are preferably provided with two or more clip-type terminals projecting from a common base portion. In all other respects, the terminals employ a pair of cantilevered arms which project to form a narrow slot therebetween which is gapped apart somewhat by coining of the material of the arms along some portion of the slot. Preferably the coining is done where the slot meets an enlarged recess formed between the terminal arms, which imparts resiliency to the arms.

Additionally, a lead-in portion is provided in the form of an open-ended generally V-shaped notch which forms the open top portion of the terminal and extends downwardly into the slot portion. The open end of the notch portion is significantly wider than the slot to permit passage of a wire conductor with insulation downwardly into the slot portion. The open end of the notch portion is significantly wider than the slot to permit passage of a wire conductor with insulation thereon freely therethrough. When the wire conductor reaches the junction of the notch and the somewhat spread apart slot portion, the relatively sharp and substantially 90° corner edges of the slot slice the insulation therefrom. The conductor portion of the wire is thereafter tightly held within the slot in electrically conductive contact with the terminal. The provision of such multiple terminals on a common base allows the interconnection of multiple wires for purposes of making connections between incoming cables and inside equipment, for example. While the type of terminal block assembly and terminals described in the above-mentioned U.S. patents have proven highly successful in practice, there is room for further improvement.

The cost of manufacturing terminal blocks and terminals of the type shown in the above-mentioned patents has been steadily increasing. A significant portion of this increase is the raw material costs and particularly the cost of the copper material from which the terminal clips are fabricated. Accordingly, we have attempted to produce a modified clip and block which utilizes substantially less copper material and yet produces a clip and block which have the same external dimensions, so that the block can be used in existing installations.

More particularly, we have redesigned the clip so that the wire receiving portion thereof has a substantially identical appearance and configuration to that of the clip shown in the aforesaid patent to Troy but of reduced thickness. The base portion thereof, which is mounted within the terminal block, is also of reduced thickness and also of substantially reduced dimensions resulting in a substantial overall reduction in weight of the clip as a whole. We have also redesigned the clip so that the performance of the clip will not change in spite of this reduction of weight. That is, the redesigned clip retains an acceptable level of stress, deflection and gripping force between the cantilevered arms thereof to give substantially the same performance in stripping insulation from a wire and thereafter retaining a wire, when a wire is pushed into the clip. Moreover, the same tools presently in use in the field with the present terminal clip and block may be used with our new terminal clip and block. That tool may be of the type shown in FIGS. 6 and 7 of the above-mentioned Sedlacek patent.

OBJECTS AND SUMMARY OF THE INVENTION

Accordingly, it is an object of the invention to provide a novel and improved clip-type terminal which is substantially less expensive than the present type, but which has substantially the same external appearance and performance when mounted in place on a terminal block.

A related object is to provide a novel and improved terminal block for mounting clips in accordance with the foregoing object which is substantially identical in its dimensions and mounting requirements to the presently used terminal block.

Briefly, and in accordance with the foregoing objects a terminal assembly includes a block and a plurality of clip-type terminals mounted to the block. The block is a dielectric body having a central section and fanning strip sections at opposed margins. The terminals are loosely received through the holes and have wire receiving portions on one side of the central section and lying intermediate the fanning-strip sections and base portions on the opposite side of the central section. A retaining plate engages with the body for enclosing the base portions of the terminals within the dielectric body. The retaining plate further has a plurality of elongate, parallel and spaced-apart raised rib portions arranged for engaging the base portions of the terminals, such that wire receiving portions thereof are held in position projecting through the holes. The terminals comprise clip terminals having a flat body that includes two opposed resilient arms cantilevered from the base of the terminal The resilient arms are separated by a notch at an upper end for receiving a wire conductor, by a conductor-receiving slot that extends downwardly from a lower end of the notch, and by an enlarged aperture extending downwardly from a lower end of the slot to the base. Oppositely outwardly facing edges of the resilient arms extend downwardly at a divergent angle to the base and inwardly facing edges of the resilient arms defining the aperture diverge at a substantially identical angle, such that the portions of the resilient arm flanking the aperture are of constant width.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawing in which like reference numerals identify like elements, and in which:

DETAILED DESCRIPTION OF THE ILLUSTRATED EMBODIMENT

Figure 1:
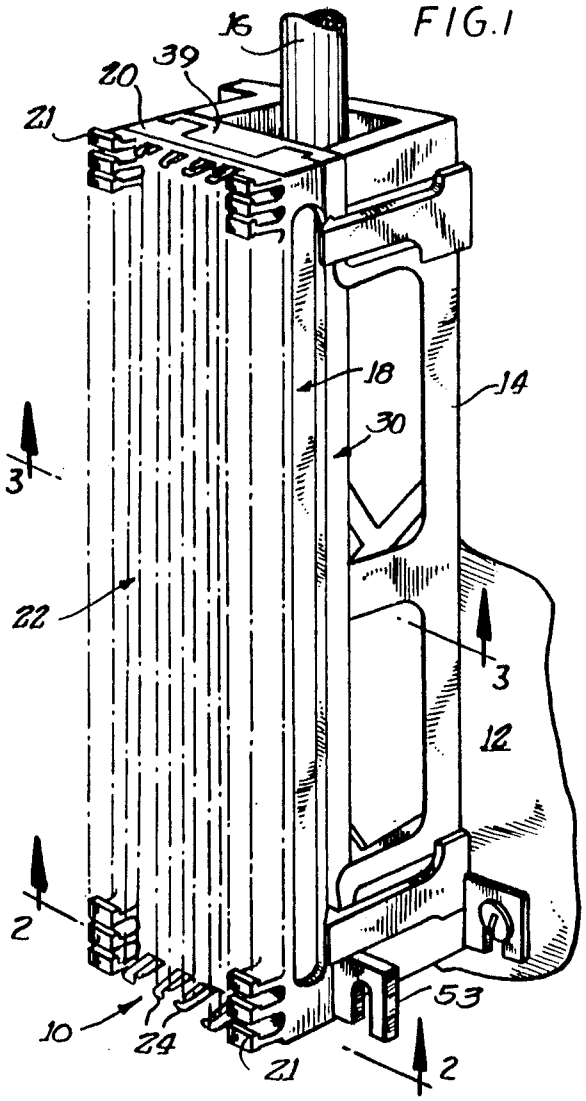
FIG. 1 is a perspective view of a terminal block assembly according to the invention, assembled to a mounting surface by use of a standoff bracket.

Turning now to the drawings, and initially to FIG. 1, there is shown a terminal block 10 which may be mounted to a wall or other vertical support surface 12. In FIG. 1 an additional hold-off bracket 14 is utilized to mount the terminal block 10 to the wall, such that a cable 16 may be run through the hold-off bracket 14 and behind the terminal block 10. In the illustrated arrangement, further similar terminal blocks and hold-off brackets may be mounted in end-to-end vertical relationship with the terminal block 10 and bracket 14. This arrangement is such that cable 16 may be fanned out as desired to a plurality of similar terminal blocks in a vertical end-to-end array.

Figure 2:
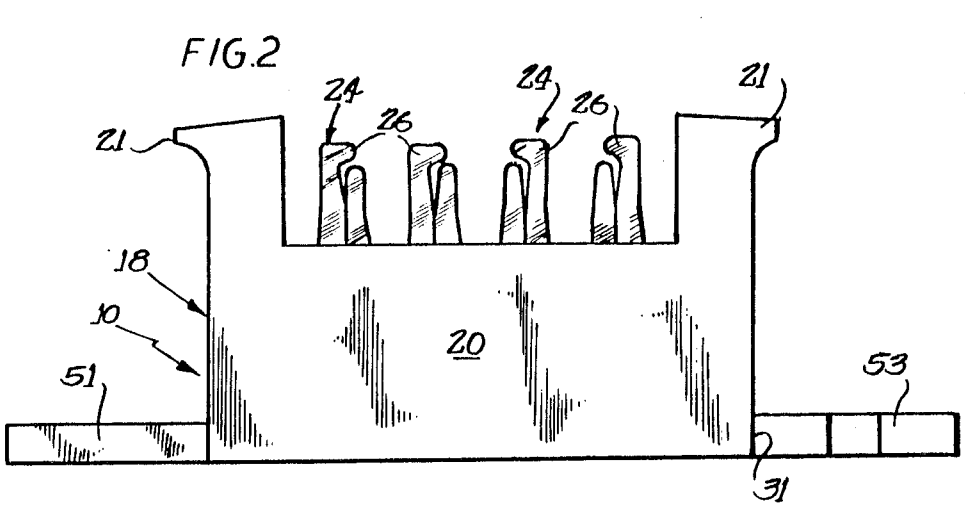
FIG. 2 is an end view of the terminal block assembly of the assembly of FIG. 1.
Figure 3:
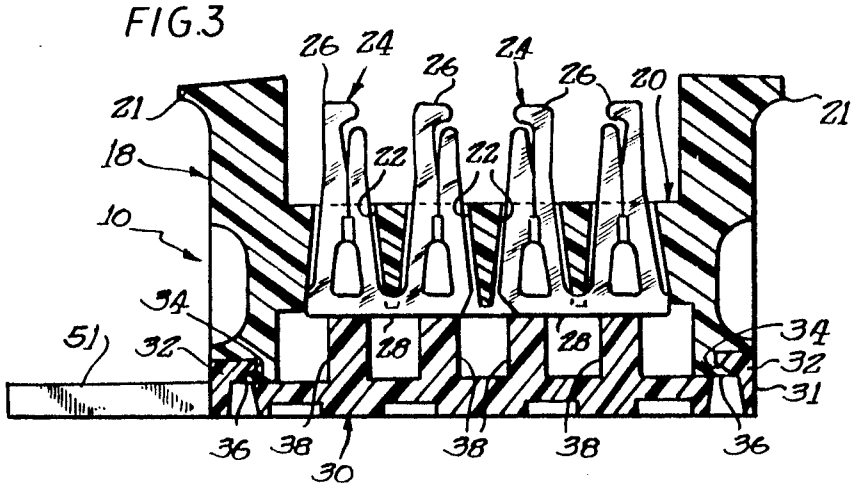
FIG. 3 is a sectional view through the terminal block assembly of FIG. 1, taken generally along the line 3—3 of FIG. 1.
Figure 4:
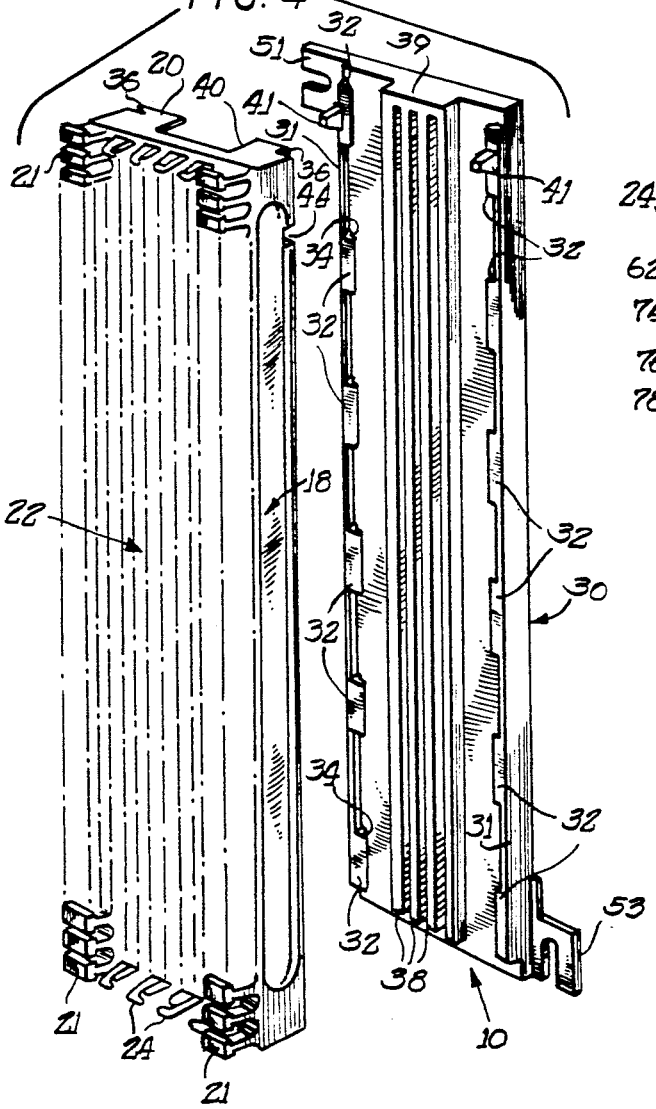
FIG. 4 is an exploded view of the terminal block assembly of FIG. 1.

Referring now also to FIGS. 2–4, the terminal block 10 will be seen to comprise a dielectric body portion 18 having a central section 20 and a pair of opposed fanning strips 21, 21 along the lengths of the longitudinal margins of the central section 20. Formed in the central section 20 are a plurality of rows of side-by-side holes 22 which are in the form of narrow slots. These holes or slots are disposed in the central section in a generally rectangular, matrix-like pattern of rows and columns.

Positioned in each hole or slot 22 is an electrically conductive terminal 24. Exact construction and configuration of these terminals in accordance with the invention will be more fully described hereinbelow. At present, suffice it to say that these terminals 24 have wire-receiving portions 26 at one side of the central section 20 of the body 18 and base portions 28 on the opposite side of the central section 20. That is to say, the wire receiving portions 26 project through the holes or slots 22 for access from the front or exposed side of the terminal block as viewed in FIG. 1. On the other hand, these wire-receiving sections or portions 26 are supported by and extend from the respective base portions or sections 28 which mount behind the holes or slots 22 in the central section 20. The wire-receiving portions 26 are located between the fanning strips 21, 21 so that individual conductors or wires from the cable 16 can be broken out from the cable, pass through the fanning strips and thus guide it to connect with the desired ones of the wire-receiving portions 26.

In order to retain the terminals 24 in the illustrated condition projecting through the holes or slots 22, a retaining plate 30 is used. The retaining plate 30 includes longitudinal side portions 31, 31 which terminate in longitudinally grooved flanges 32, 32. These flanges define grooves 34, 34 of generally triangular cross-section. These grooves are of complementary shape for slidably interfitting with and receiving corresponding longitudinal ribs 36, 36 which are integrally formed in an oppositely outwardly facing configuration on the terminal block body 18 adjacent its bottom side. The retaining plate 30 and body 18 are of the same length and are assembled by lining up the grooves 34, 34 with the ribs 36, 36 and then moving the body and retaining plate relatively longitudinally together such that the ribs and grooves slidably interengage. This assembly procedure is carried out after the terminals 24 have been inserted into all of the holes or slots 22, and preferably with the assembly held such that the terminals are in inverted position. That is, the assembly is held such that the wire-receiving portions 26 face vertically downwardly so that the terminals will be temporarily retained in the holes or slots by gravity during the assembly procedure.

In order to securely retain the terminals 24 within the holes or slots 22, the retaining plate 30 is additionally provided with a plurality of longitudinally extending raised ribs 38 in a parallel and spaced-apart condition and running substantially the entire length thereof. These raised ribs are arranged for projecting into the central section of the body behind the holes or slots 22 and engaging the base portions 28 of the terminals. The engagement of the ribs with the base portions of the terminals is such that the wire-receiving portions 26 thereof are held firmly in position, projecting through the holes or slots 22, but such that portions 26 can flex as necessary to receive wires.

As will be seen later two or more wire receiving portions 26 may project from a single base portion 28. Accordingly, the ribs 38 are at least equal in number to the number of base portions 28 employed, rather than to the number of terminal wire-receiving portions 26 as such. Moreover, the ribs are also preferably arranged so as to engage and support each of the respective base portions. Accordingly, the number and arrangement of ribs 38 illustrated is by way of example only, and does not in any way limit the invention. It is noted, however, that the ribs 38 extend longitudinally along the length of the retaining plate 30 such that each rib supports each and every terminal member base 28 which is aligned behind a given column or columns of the holes or slots 22 from one end of the terminal block body 18 to the other. Hence the ribs are at least equal in number to, and spaced apart for engagement with, a number of terminals which are arranged side-by-side in the holes, such that each terminal is supported by at least one of the raised ribs.

Figure 5:
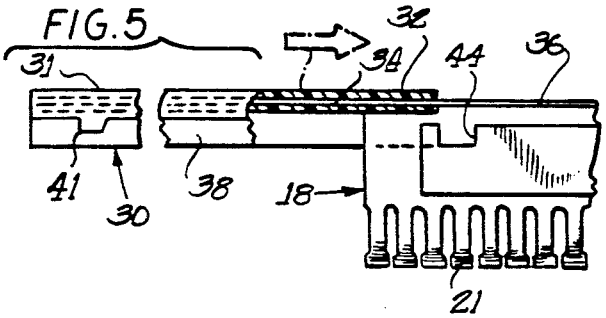
FIG. 5 is a fragmentary view, partially broken away, and illustrating the manner in which a retaining plate interfits with the terminal block body portion of the assembly of FIG. 1.

Cooperatively, it will be seen that one end face of the terminal block body 18 is formed with a recess or cutout portion 40 to permit slidable entry of the ribs 38 therethrough as the body and retaining plate are slidably interfitted as described above and as also indicated somewhat diagrammatically in FIG. 5. The ribs form a corresponding closed face 39 at their corresponding end to close off the slot 40 when the two members 18, 30 are fully engaged, and also form a stop surface which generally defines this fully engaged position.

In accordance with the embodiment of the invention illustrated herein and referring also to FIG. 4, a further arrangement is provided for retaining the plate 30 assembled with the terminal block body 20. This arrangement includes a pair of ramped tabs 41, 41 which are integrally molded with the retaining plate 30 projecting upwardly from the slide portions 31, 31 thereof. As best viewed in FIG. 5, each tab 41 is adapted to snap under and lock behind a recessed shoulder 44, which presents itself in the respective sides of the body 18 below the fanning strips 21. Thus when the body and retaining plate are assembled by the sliding engagement of the grooves 34 with the ribs 36, the tabs 41 will engage recessed shoulders 44. Hence, in effect the tabs 41 snap into and abut recessed shoulders 44 so as to prevent movement back in the direction of insertion—that is, relative slidable disassembly of the retaining plate from the body 20. The tabs 41 can be manually depressed or depressed with a tool if deliberate disassembly is desired.

The retaining plate 30 is also formed with respective top and bottom attaching ears 51, 53 which are preferably slotted to receive screws, and by which the retaining plate with the assembled body 18 may be mounted on a frame or other supporting surface. However, as illustrated in FIG. 1, it is often desired to use an additional stand-off bracket 14 for mounting the terminal block assembly 10 to a supporting surface. Preferably, this is accomplished in a similar fashion to what is shown in the above-mentioned U.S. Pat. No. 3,957,335.

Figure 6:
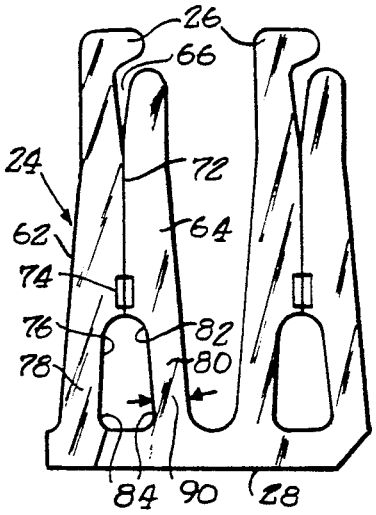
FIG. 6 is an elevation of a terminal clip in accordance with a preferred embodiment of the invention illustrated herein.
Figure 7:
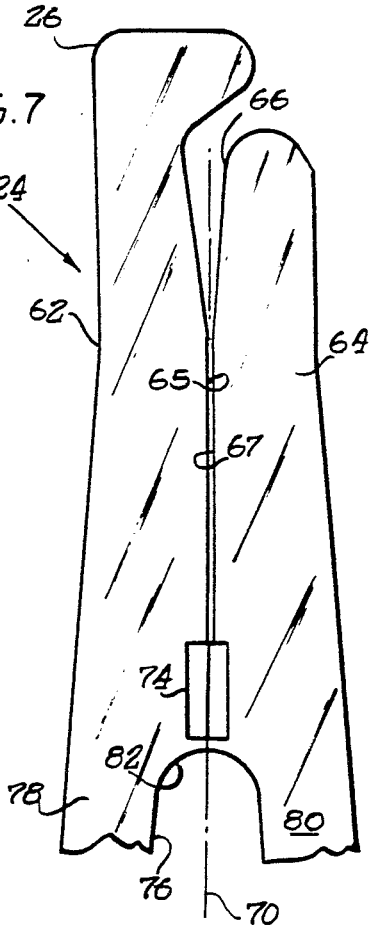
FIG. 7 is an enlarged partial view of the terminal clip of FIG. 6.

Referring now to FIGS. 6 and 7, the details of a clip type terminal in accordance with the invention will be further described. The terminal of the invention is preferably about three-fourths of the overall height of the prior terminal clip (as is shown in U.S. Pat. No. 3,957,335). In order to retain substantially the same deflection constant and to maintain acceptable holding forces and stresses when a wire is held in the terminal, the thickness of the terminal and the width of the arms of the terminal at the bottom of the aperture, are also varied from the dimensions of the prior terminal. These variations are also such that the terminal of the invention requires only on the order of two-thirds of the material of the prior terminal.

In accordance with the illustrated embodiment, each terminal 24 includes two wire-receiving portions 26, 26 which extend from a common base 28. The wire-receiving portions are identical such that only one will be described herein in detail. It will be noted that the terminal 26 includes a generally flat body of a substantially constant thickness, which has a pair of opposed resilient arms 62 and 64 cantilevered from the common base part 28. The resilient arms 62 and 64 are separated by a generally V-shaped notch 66 at the upper end of the terminal for receiving a wire conductor to be terminated and held between the arms 62, 64. In the illustrated embodiment, the upper end of the notch 66 is formed at approximately a 45° angle to the V-shaped main portion thereof. However, a non-angled upwardly opening V-shaped entrance might also be utilized without departing from the invention. In the illustrated embodiment, the angle defined by the notch 66 is substantially on the order of 14° and is substantially symmetrical about a vertical central axis 70 of the terminal.

The two arms have facing, substantially parallel edges 65, 67 immediately below the notch 66, which define therebetween a narrow slot 72. The arms 62, 64 are spread apart slightly at slot 72 during manufacture by coining surface portions of the arms 62, 64 adjacent the inwardly facing edges 65, 67 thereof as indicated generally at reference numeral 74. Referring to FIG. 7, this coining also serves to define relatively sharp edges, where the notch 66 meets slot 72, which serves to encourage slicing of the insulation cleanly from a wire conductor which is pushed through the notch and into the slot. Generally speaking, a tool is utilized to introduce the wire into the terminal in this fashion. Moreover, it will be appreciated that since these wire-receiving portions of the terminal 24 are substantially identical to the terminal presently in use, the same tool presently in use may be utilized to terminate wires with the modified terminal of the present invention. That tool may be of the type shown in FIGS. 6 and 7 of the above-mentioned Sedlacek '500 patent.

Below the slot 72, a cutout portion or enlarged aperture 76 is defined between the arms 62 and 64. This aperture extends downwardly from the lower end of the slot generally to the base portion 28 from which the arms are commonly cantilevered.

The terminal of the invention has its arms 62 and 64 shaped to define a generally divergent downwardly opening aperture 76. That is, both the outwardly and inwardly facing edges of the arms 62, 64 about the slot 76 extend at a divergent angle downwardly from generally an upper portion of the slot 72 to the point where the arms meet the base 28, such that the portions 78 and 80 of the arms which flank the aperture 76 are of constant and equal width as indicated by reference numeral 90. Moreover, the geometry of the arms is symmetrical such that these constant width arm portions 78 and 80 are of substantially equal width 90 and length, and diverge at substantially equal and symmetrical angles from the lower part of the slot to the common base part of the body from which the arms are cantilevered. In the illustrated embodiment, these equal angles of divergence are substantially on the order of 5°. It will be noted that the portions of the arms 78, 80 which generally define the aperture 76 also have rounded edges 82 and 84 at upper and lower peripheral portions of the aperture 76.

In accordance with the preferred form of the invention illustrated herein, we have determined a preferred thickness of the terminal and width 90 of the portions 78, 80 of the arms adjacent the aperture. We have determined that the ideal dimension for the thickness of the terminal is substantially on the order of 0.032 inches and that the ideal dimensions for the width 90 of portions 78,

80 is substantially on the order of 0.067 inches. This results in the use of about 64.7% of the material used in the prior terminal.

We have also found that maintaining these dimensions maintains substantially the same deflection of the arms, upon introduction of a 22 gauge wire as the prior terminal; that is, on the order of 0.0086 inches. The loading and stress factors on the present terminal with the 22 gauge wire held therein are also within acceptable limits. We have measured a load as the result of deflection of on the order of 7.8 lb. We have measured stress at the bottom of the aperture at on the order of 52,426 lbs./sq. in. Preferably, this stress should be no greater than 55,000 pounds per square inch. Accordingly, we have discovered how to construct a substantially shorter terminal, using less material, which nonetheless retains substantially identical appearance, when mounted in the block, to the presently used terminal, and which meets the relevant loading and stress requirements.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A clip terminal of the insulation-removing type comprising a flat body that includes two opposed resilient arms cantilevered from a common part of the body, said resilient arms being separated by a notch at an upper end for receiving a wire conductor to be held between said arms, said arms having facing substantially parallel edges forming side portions of a conductor-receiving slot that extends downwardly from a lower end of said notch, and an enlarged aperture extending downwardly from a lower end of said slot to the said body part from which said arms are commonly cantilevered; wherein oppositely outwardly facing edge portions of said resilient arms extend downwardly at a divergent angle to the point at which said resilient arms are cantilevered from said common part of the body, and wherein inwardly facing edges of said resilient arms defining said aperture diverge at a substantially identical angle, such that the portions of said resilient arms flanking said aperture are of constant width; wherein the thickness of said terminal and the width of each of said arms at said aperture are selected such that with a 22 gauge wire held in said terminal, stress on said arms at the bottom of said slot is no greater that substantially on the order of 55,000 pounds per square inch.

2. A clip terminal according to claim 1 wherein said constant width arm portion are of substantially equal length.

3. A clip terminal according to claim 1 wherein surface portions of said arms adjacent inwardly facing edges thereof along said slot are coined to cause a spreading apart of said slot and said notch for accepting a wire of a given gauge therein and for stripping the insulation from said wire as the same is advanced through said notch and into said slot.

4. A clip terminal according to claim 1 wherein the portions of said arm defining said aperture have rounded edges at upper and lower peripheral portions of said aperture.

5. A clip terminal according to claim 1, wherein the thickness of said terminal and the width of each of said arms at said aperture are selected such that the deflection of each arm, with a 22 gauge wire held in said terminal, is substantially on the order of 0.0086 inches.

6. A clip terminal according to claim 1 in which said constant width arm portions diverge at substantially equal and symmetrical angles from a lower end part of said slot to the said common part of the body from which said arms are cantilevered.

7. A clip terminal according to claim 6 wherein said equal angles of divergence are substantially on the order of 5°.

8. A clip terminal according to claim 1, wherein the thickness of said terminal and the width of each of said arms at said aperture are selected such that the clamping force exerted by said terminal on a 22 gauge wire is substantially on the order of 7.8 pounds.

9. A clip terminal according to claim 8, wherein said thickness of said terminal is substantially on the order of 0.032 in. and said width of each arm adjacent said aperture is substantially on the order of 0.067 inches.

10. A terminal block assembly for mounting a plurality of clip-type terminals, and comprising: a dielectric body having a central section and fanning strip sections at opposed margins of said central section; said central section having a plurality of side-by-side rows of holes; electrically conductive terminals loosely received in said holes and projecting therethrough, said terminals having wire receiving portions on one side of said central section and base portions on the opposite side of said central section and in engagement therewith, said wire receiving portions lying intermediate said fanning-strip sections; a solid retaining plate on said central section for covering enclosing and protecting said base portions of said terminals within said central section of said dielectric body; wherein said retaining plate and said body have complementary slidably engageable rib means and slide portions for effecting slidable engagement and disengagement for assembly and removal of said retaining plate with said central section; said retaining plate further including a plurality of elongate, parallel and spaced apart raised rib portions arranged for projecting into said central section of said body and engaging said base portions of said electrically conductive terminals, such that wire receiving portions thereof are held in position projecting through said holes.

11. A terminal block assembly according to claim 10 wherein said ribs are at least equal in number to, and spaced apart for engagement with, a number of terminals which are arranged side-by-side in said holes, such that each terminal is supported by at least one of said raised ribs.

12. A terminal block assembly according to claim 10 and further including recess means formed in an end face of said central section for permitting slidable movement of said raised ribs therethrough for engagement with said terminal base portions.

13. A terminal block assembly according to claim 10 wherein each of said terminals comprises a clip terminal of the insulation-removing type comprising a flat body that includes two opposed resilient arms cantilevered from a common part of the body which forms the base portion of terminal, said resilient arms being separated by a notch at an upper end for receiving a wire conductor to be held between said arms, said arms having facing substantially parallel edges forming side portions of a conductor-receiving slot that extends downwardly from a lower end of said notch, and an enlarged aperture extending downwardly from a lower end of said slot to the said body part from which said arms are commonly cantilevered; wherein oppositely outwardly facing edges of said resilient arms extend downwardly at a divergent angle to the point at which said resilient arms are cantilevered from said common part of the body, and wherein inwardly facing edges of said resilient arms defining said aperture diverge at a substantially identical angle, such that the portions of said resilient arms flanking said aperture are of constant width.

14. A terminal block assembly according to claim 13, wherein the thickness of said terminal and the width of each of said arms at the widest part of said aperture are selected such that with a 22 gauge wire held in said terminal, stress on said arms at the bottom of said slot is no greater than substantially on the order of 55,000 pounds per square inch.

15. A terminal block assembly according to claim 13, wherein the thickness of said terminal and the width of each of said arms at the widest part of said aperture are selected such that the deflection of each arm, with a 22 gauge wire held in said terminal, is substantially on the order of 0.0086 inches.

16. A terminal block assembly according to claim 13, wherein the thickness of said terminal and the width of each of said arms at said aperture are selected such that the clamping force exerted by said terminal on a 22 gauge wire is substantially on the order of 7.8 pounds.

17. A terminal block assembly according to claim 16, wherein said thickness of said terminal is substantially on the order of 0.032 in. and said width of each arm adjacent said aperture is substantially on the order of 0.067 inches.

18. A clip terminal of the insulation-removing type comprising a flat body that includes two opposed resilient arms cantilevered from a common part of the body, said resilient arms being separated by a notch at an upper end for receiving a wire conductor to be held between said arms, said arms having facing substantially parallel edges forming side portions of a conductor-receiving slot that extends downwardly from a lower end of said notch, and an enlarged aperture extending downwardly from a lower end of said slot to the said body part from which said arms are commonly cantilevered; wherein oppositely outwardly facing edge portions of said resilient arms extend downwardly at a divergent angle to the point at which said resilient arms are cantilevered from said common part of the body, and wherein inwardly facing edges of said resilient arms defining said aperture diverge at a substantially identical angle, such that the portions of said resilient arms flanking said aperture are of constant width; wherein the thickness of said terminal and the width of each of said arms at said aperture are selected such that the clamping force exerted by said terminal on a 22 gauge wire is substantially on the order of 7.8 pounds.

19. A clip terminal of the insulation-removing type comprising a flat body that includes two opposed resilient arms cantilevered from a common part of the body, said resilient arms being separated by a notch at an upper end for receiving a wire conductor to be held between said arms, said arms having facing substantially parallel edges forming side portions of a conductor-receiving slot that extends downwardly from a lower end of said notch, and an enlarged aperture extending downwardly from a lower end of said slot to the said body part from which said arms are commonly cantilevered; wherein oppositely outwardly facing edge portions of said resilient arms extend downwardly at a divergent angle to the point at which said resilient arms are cantilevered from said common part of the body, and wherein inwardly facing edges of said resilient arms defining said aperture diverge at a substantially identical angle, such that the portions of said resilient arms flanking said aperture are of constant width; wherein the thickness of said terminal and the width of each of said arms at said aperture are selected such that the deflection of each arm, with a 22 gauge wire held in said terminal, is substantially on the order of 0.0086 inches.

* * * * *